US006135288A

United States Patent [19]

Kim

[11] Patent Number: 6,135,288

[45] **Date of Patent: *Oct. 24, 2000**

[54] CORRUGATED BOARD PACKAGING BOX

[76] Inventor: Seung-Wook Kim, 590-4, Sam-ri, Silchon-myeon, Kwangju-koon, Kyungki-do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/987,964

[22] Filed: Dec. 10, 1997

Related U.S. Application Data

[63] Continuation-in-part of application No. 08/905,594, Aug. 4, 1997, abandoned.

[30] Foreign Application Priority Data

Nov. 7, 1996 [KR] Rep. of Korea ..... 96-39448
Jul. 11, 1997 [KR] Rep. of Korea ..... 97-18282

[51] Int. Cl.[7] ..... B65D 5/54

[52] U.S. Cl. ..... 206/738; 206/769; 229/122; 229/242

[58] Field of Search ..... 206/772, 775, 206/526, 736, 738, 769, 777, 782; 229/122, 122.1, 162, 242

[56] References Cited

U.S. PATENT DOCUMENTS

| | | | |
|---|---|---|---|
| 1,490,215 | 4/1924 | Kaufman | 206/769 |
| 1,855,555 | 4/1932 | Miller | 229/122 |
| 2,556,707 | 6/1951 | Randall et al. | 229/122.1 |
| 3,923,160 | 12/1975 | Hirano et al. | 206/446 |
| 4,170,325 | 10/1979 | Pawlowski et al. | 206/526 |
| 4,205,776 | 6/1980 | Ruer | 229/120.01 |
| 4,809,847 | 3/1989 | Schneider | 206/772 |
| 4,865,187 | 9/1989 | Zulauf et al. | 206/772 |
| 4,992,068 | 2/1991 | Conrad | 229/122 |
| 5,368,194 | 11/1994 | Oliff et al. | 221/305 |
| 5,413,276 | 5/1995 | Sheffer | 229/120.11 |
| 5,462,169 | 10/1995 | Dygert et al. | 229/242 |

*Primary Examiner*—Jim Foster
*Attorney, Agent, or Firm*—Mathews, Collins, Shepherd & Gould, P.A.

[57] ABSTRACT

A corrugated board packaging box including an opening portion which is formed on a front surface portion of a box body, through which goods are taken in and out. On both sides of the front surface portion, a cut-off portion is formed to cut off by a cutting line, defined by a vertical supporting member disposed on the intermediate portion of the front surface, and on an edge of the one side of the cut-off portion, a cut-off protrusion is disposed by forming an inclined cutting line.

2 Claims, 9 Drawing Sheets

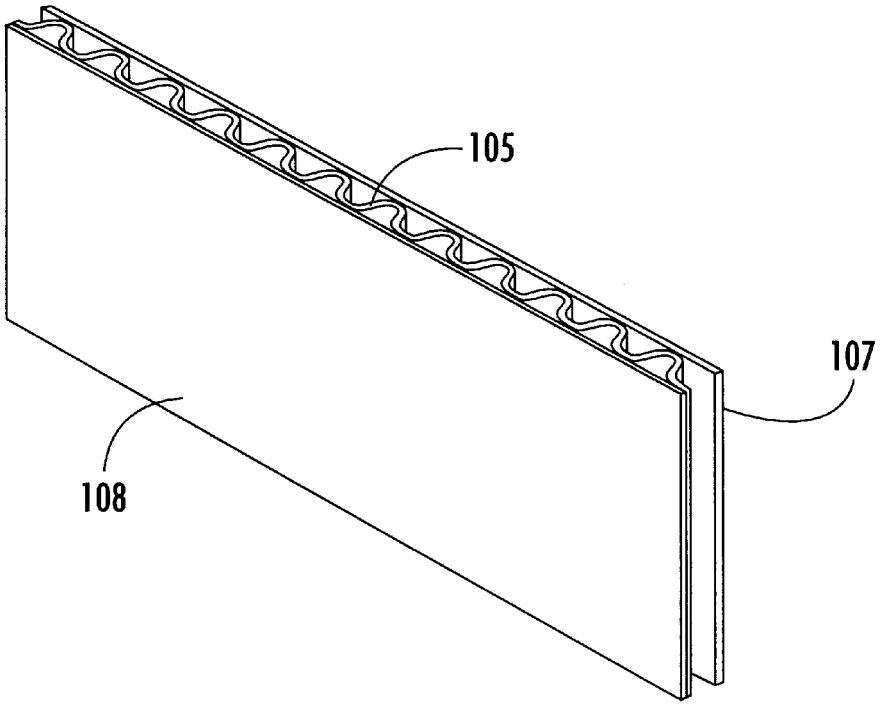
FIG. 12a.
(PRIOR ART)
FIG. 12b.
(PRIOR ART)
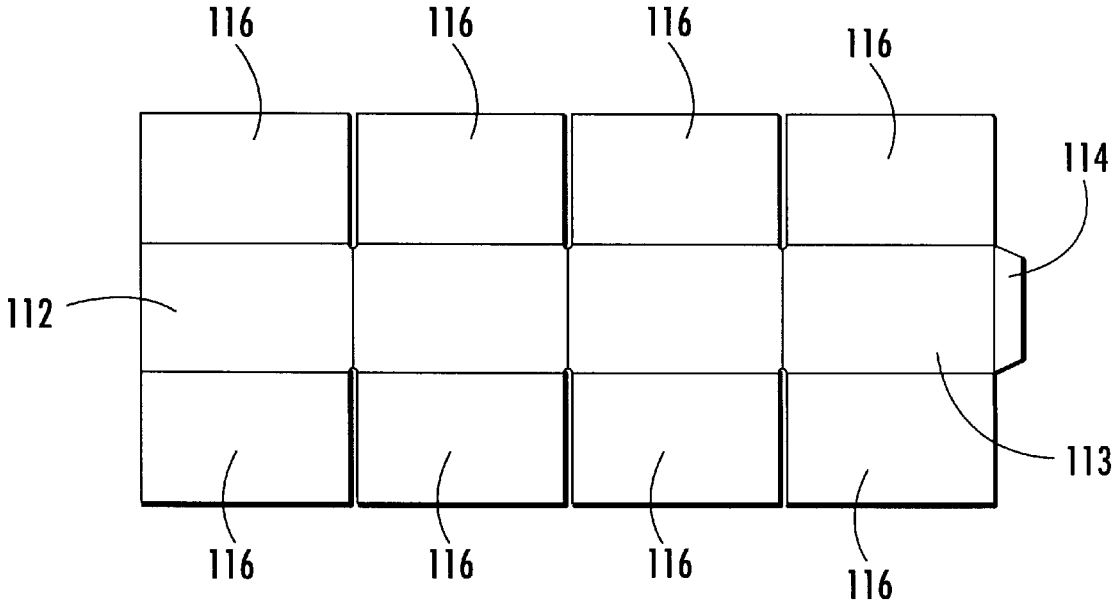

CORRUGATED BOARD PACKAGING BOX

This application is a continuation-in-part of application Ser. No. 08/905,594 filed Aug. 4, 1997, abandoned, hereby incorporated by reference.

BACKGROUND OF THE INVENTION

1. Field of the Invention

The present invention relates to a corrugated board packaging box in which the commodities placed in the interior of a box body can be displayed, without opening any cover plate, and can be taken out of the interior thereof to be sold, in the state where a plurality of boxes are piled up.

2. Discussion of the Prior Art

FIG. 12A is a perspective view illustrating a conventional corrugated board. The conventional corrugated board is comprised of first and second plane sheets 107 and 108 which are formed on the both sides of a corrugated sheet 105 to be adherent onto the corrugated sheet 105 by an adhesive material.

FIG. 12B is an exploded view illustrating a conventional corrugated board box manufactured using the corrugated board as above constructed. Referring to FIG. 12B, in construction, a flap 114 is formed as a unitary body on the end portion of the one side of a tetrahedral corrugated board 113, and after the flap 114 and another tetrahedral corrugated board 112 are adhesive to each other by means of an adhered material, upper and lower cover plates 116 are folded to thereby complete the formation of the corrugated board box.

Accordingly the corrugated board packaging box in which a plurality of commodities packaged are contained is conveyed or kept under the state where the cover plates thereof are closed. Hence, there exists an inconvenience if the cover plates of the corrugated board packaging box should be opened to display or sell the commodities contained in the packaging box.

Moreover, so as to take the commodities out of the packaging box and display the commodities in an appropriate manner, since an additional space in which a display stand has to be placed in a shop should be needed, the installation cost of the display stand is separately required. On the other hand, since the packaging boxes in which the commodities are contained can not be all piled up within the shop, the storage area of the packaging boxes has to be additionally occupied.

The conventional corrugated board box includes the corrugated sheet which is formed between the inside and outside plane sheets, but the outer surface of the outside plane sheet exhibits a weaky buffering force and is easily destroyed. To solve this defect of the outside plane sheet, the outer surface thereof is formed to be smooth, but when the packaging boxes are lifted or conveyed or when a plurality of packaging boxes are piled up, an unexpected sliding phenomenon occurs due to the smoothing outer surface, to thereby make the handling of the boxes considerably difficult. In addition, in the case where the piled up packaging boxes fall down, the commodities contained in the boxes as well as the boxes themselves or even other commodities disposed around the packaging boxes are damaged, unfortunately.

Moreover, at the time of folding the conventional packaging box in the tetrahedral shape, the adhesive material is applied on the flap 114. However, the adhesive material generally shows an irregular viscosity and pouring amount.

Accordingly, in the case where a large quantity of adhesive materials are applied because the adhesive material has a low degree of viscosity, the surface with which the flap 114 is connected and an adjacent surface thereto are connected to each other. Thus, if a consumer uses such the packaging box, the packaging box can not be easily opened even using an automatic machine. Meanwhile, in the case where a projection is formed in the inside or outside direction of the flap 114 as thick as the flap and the commodities are automatically contained within the packaging box, since the commodities are pushed into the packaging box being laid flat, the commodities have often tripped against the projection. As a result, if the tripping problem is generated in the current packaging box during the automatic-processing of the inputs of commodities, the commodities in the next packaging box can not be sequentially contained, to uneffectively stop the packaging operation.

A conventional corrugated board box is well disclosed in U.S. Pat. No. 4,252,236. In the prior art, the corrugated board box forms a coupling member in a cut-off state from the upper surface(cover plate) thereof through the wall portion of the front surface thereof. Since the edge portions in the corrugated board box are coupled in a cut-off state, in the case of piling up several boxes, the coupled portions in the cut-off state may easily break down due to impact or pressure, and in the case of delivering the boxes, the coupled portions may be torn due to even slight impact.

SUMMARY OF THE INVENTION

An object of the present invention is to provide a corrugated board packaging box which can not be easily broken down or slid during piling up or delivery, in order to be free from the above-mentioned problems.

Another object of the present invention is to provide a corrugated board packaging box which does not include a flap for connecting the four sides thereof.

Still another object of the present invention is to provide a corrugated board packaging box which is capable of exhibiting the commodities contained therein without opening the packaging of the commodities.

A corrugated board packaging box of the present invention comprises an opening portion which is formed on a front surface portion of a box body, through which commodities are taken in and out.

A corrugated board packaging box of the present invention comprises on both sides of the front surface portion, a cut-off portion which is formed to cut off by a cutting line, defined by a vertical supporting member disposed on the intermediate portion of the front surface, and on an edge of the one side of the cut-off portion, a cut-off protrusion which is disposed by forming an inclined cutting line.

A corrugated board packaging box of the present invention also comprises a supporting protrusion which is formed to be folded by a folding groove on both sides of the supporting member.

A corrugated board packaging box of the present invention also comprises interval and thickness of corrugation formed in a reinforced corrugated sheet which are designed to be half those of corrugation formed in a corrugated sheet.

A corrugated board packaging box of the present invention also comprises an opening portion which is formed on a front surface portion of a box body, through which commodities are taken in and out; and an outer surfaces which is formed with a reinforced corrugated sheet.

A corrugated board packaging box of the present invention also comprises interval and thickness of corrugation formed on a reinforced corrugated sheet which are designed to be half those of corrugation formed on a corrugated sheet installed between an inside plane sheet and an outside plane sheet.

A corrugated board packaging box of the present invention also comprises the corrugated sheet which is formed between the inside plane sheet and the outside plane sheet, and the reinforced corrugated sheet which is formed on the inside plane sheet.

A corrugated board packaging box of the present invention also comprises between the inside plane sheet and the outside plane sheet, a third plane sheet which is formed, and the corrugated sheet which is fixedly inserted between the inside plane sheet and the third plane sheet and between the third plane sheet and the outside plane sheet, the corrugated sheet having the same interval and shape of corrugations.

A corrugated board packaging box of the present invention also comprises the rein forced corrugated sheet which is formed on the outer surface of the inside plane sheet.

BRIEF DESCRIPTION OF THE DRAWINGS

Other objects and aspects of the invention will become apparent from the following description of embodiments with reference to the accompanying drawings in which:

FIG. 12A is a perspective view illustrating a conventional corrugated board; and FIG. 12B is an exploded view illustrating the conventional corrugated board box.

DETAILED DESCRIPTION OF THE PREFERRED EMBODIMENTS

Hereinafter, an explanation on the corrugated board box constructed according to a first embodiment of the present invention will be discussed in detail with reference to FIGS. 1 to 3.

Figure 1:
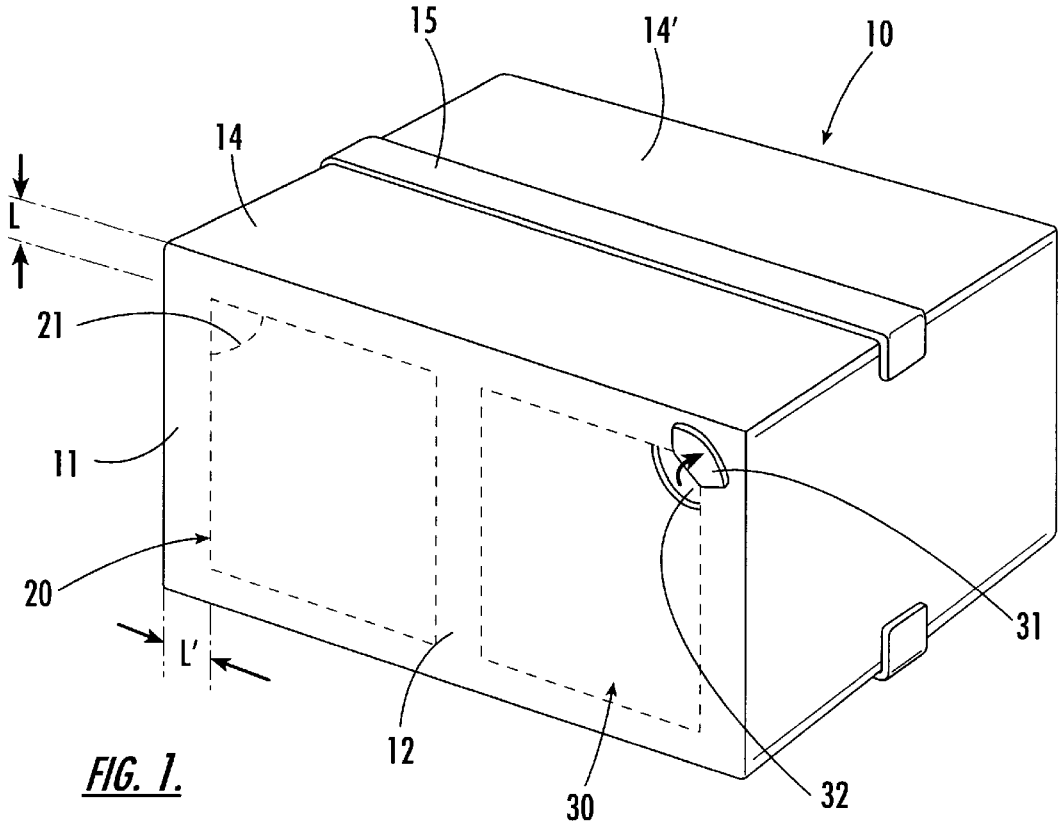
FIG. 1 is a perspective view illustrating a corrugated board box constructed according to a first embodiment of the present invention.

FIG. 1 is a perspective view illustrating a corrugated board box constructed according to a first embodiment of the present invention. FIG. 2 is a perspective view illustrating use state of a part of the corrugated board box of FIG. 1. FIG. 3 is a front view illustrating the state where several corrugated board boxes of FIG. 1 are piled up.

Figure 2:
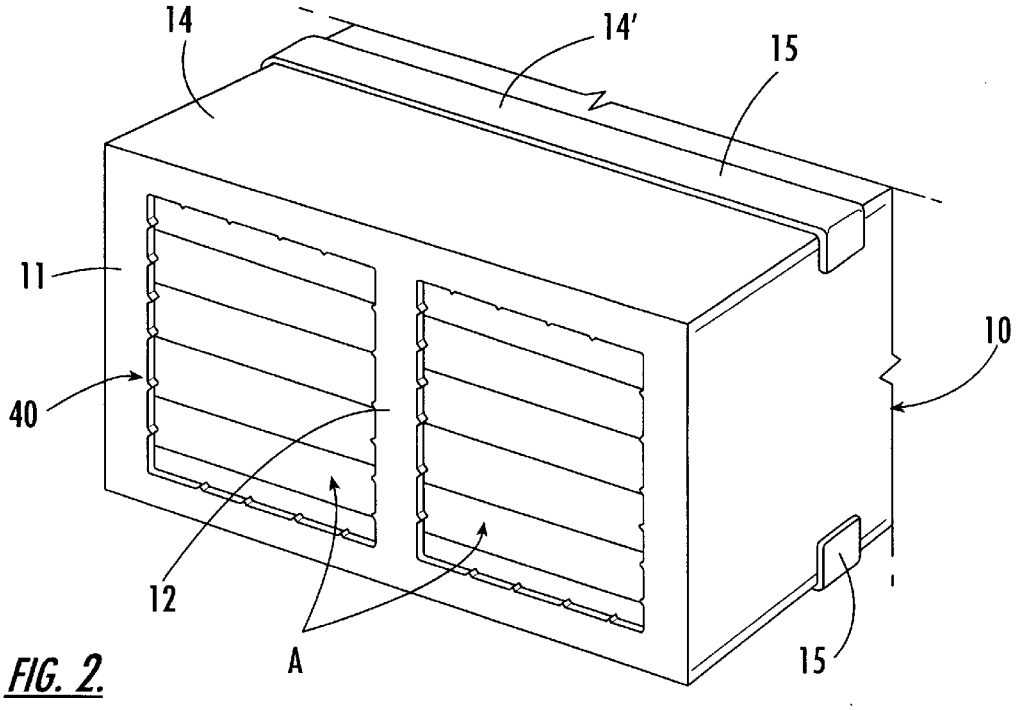
FIG. 2 is a perspective view illustrating use state of a part of the corrugated board box of FIG. 1.
Figure 3:
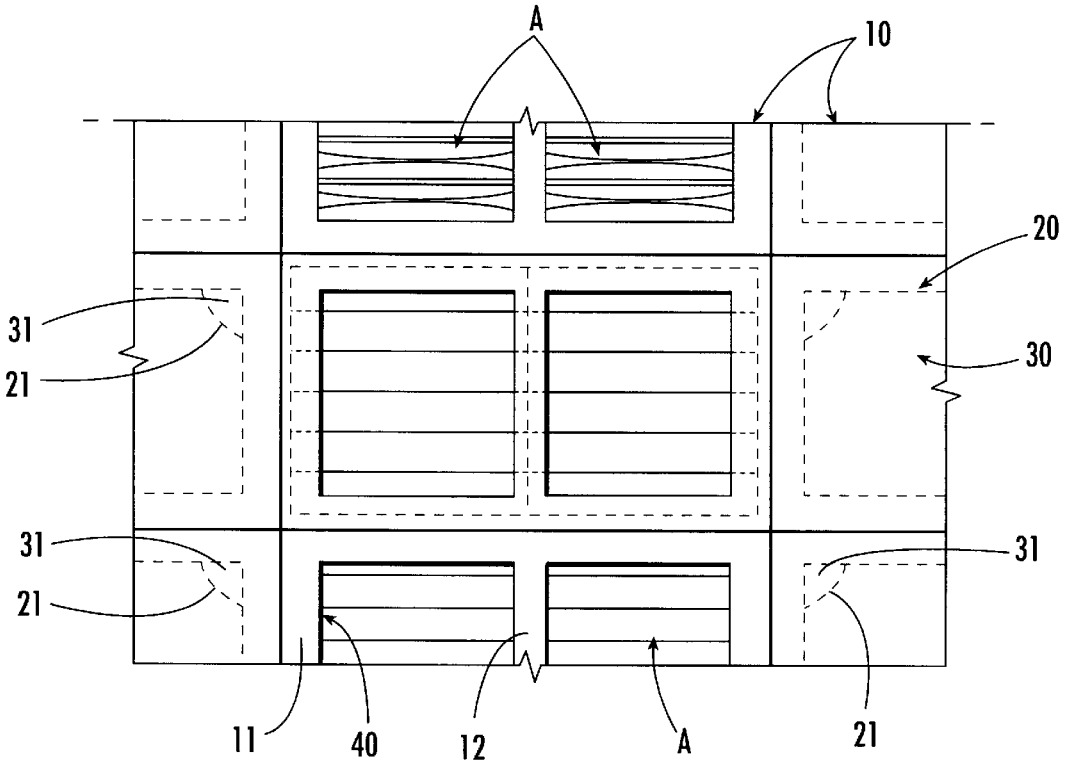
FIG. 3 is a front view illustrating the state where several corrugated board boxes of FIG. 1 are piled up.

Referring to FIGS. 1 to 3, two cut-off portions 30 are formed along a cutting line 20 which is formed in a circular or square shape, defined by a supporting member 12 on the center portion of the front surface plate 11 of a box body 10. The upper and lower end portions and the outside end portion of each of the cut-off portions 30 are spaced predetermined intervals (L and L') apart, and on the edge of the one side of each of the cut-off portions 30 a cut-off protrusion 31 is formed by an inclined cutting line 21, both ends of which are coupled to the cutting line 20.

Reference numerals 14 and 14' all designate cover plates for covering the upper opening portion of the body 10 of the box, which are sealed by means of an adhesive tape 15, after the commodities are contained in the interior of the box body 10.

An operation and effect of the corrugated board box according to the first embodiment of the present invention will be described in detail.

First, if the inclined cutting line 21 which is formed in the front surface of the box body 10 is cut off and the cut-off protrusion 31 is then detached from the box body 10, an opening hole 32 is formed in the edge of the one side of each of the cut-off portions 30.

If the cut-off portion 30 along the cutting line 20 is pulled to be detached in a state where a user's finger is inserted into the opening hole 32, an opening portion 40 is formed on the front surface plate 11 of the box body 10 and the commodities A which are piled up in the interior of the box body 10 can be seen.

As shown in FIG. 3, the commodities A stacked in the interior of the box body 10 can be exhibited under the state where a plurality of box bodies 10 are piled up. Additionally, the commodities A within the box body 10 can be taken out of the opening portion 40 and can be placed back to the interior of the box body 10 through the opening portion 40.

Since in the state where the opening portion 40 is formed on the front surface plate 11 of the box body 10 the supporting member 12 is vertically formed on the center portion of the opening portion 40, even though the plurality of box bodies 10 are stacked, the deformation of the opening portion 40 caused due to the loading of the plurality of box bodies 10 can not occur.

Figure 4A:
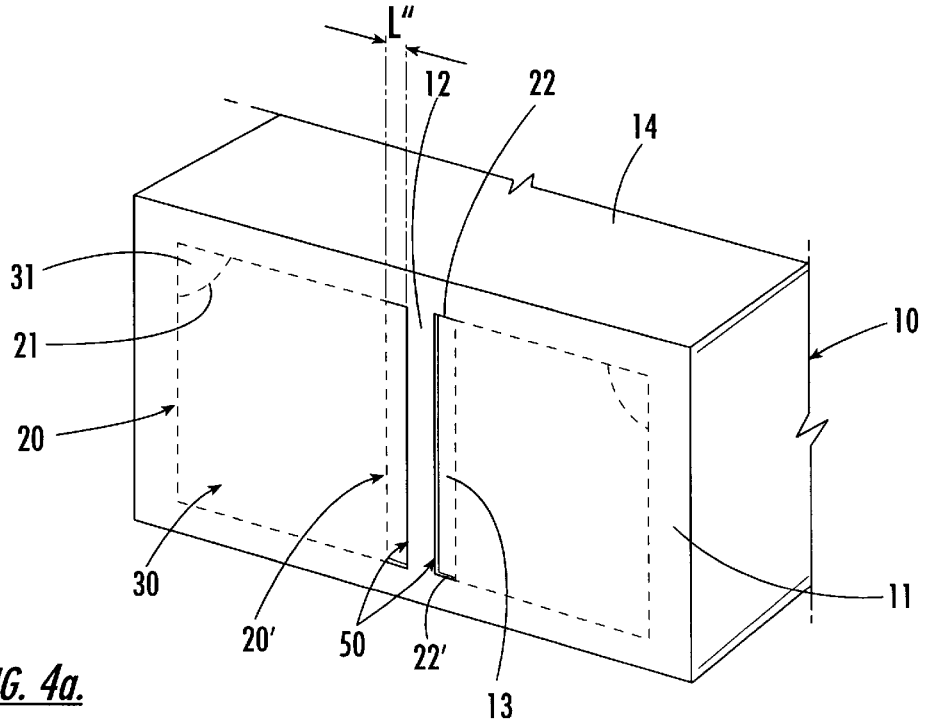
FIG. 4A is a perspective view illustrating a part of a corrugated board box constructed according to a second embodiment of the present invention.
Figure 4B:
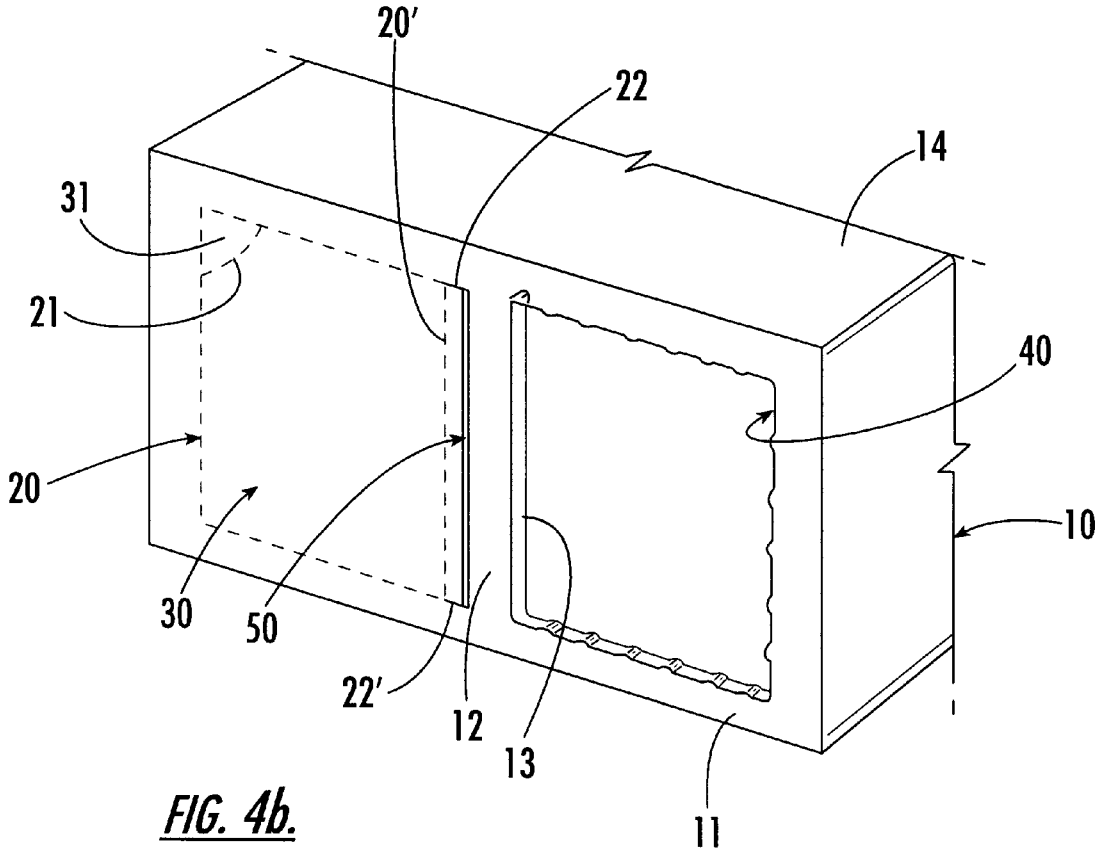
FIG. 4B is a perspective view illustrating a part cut off in the corrugated board box of FIG. 4A.
Figure 4C:
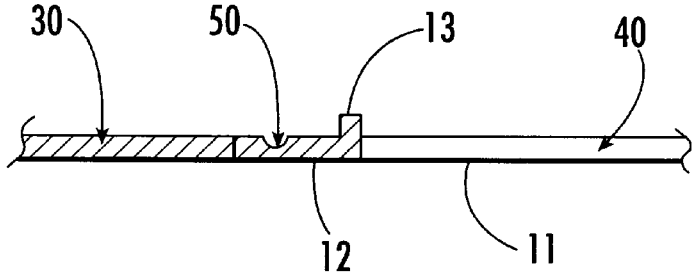
FIG. 4C is an enlarged plan sectional view illustrating main parts of the corrugated board box of FIG. 4A.

FIG. 4A is a perspective view illustrating a part of a corrugated board box constructed according to a second embodiment of the present invention. FIG. 4B is a perspective view illustrating a part cut off in the corrugated board box of FIG. 4A. FIG. 4C is an enlarged plan sectional view illustrating main parts of the corrugated board box of FIG. 4A. In the explanation of the corrugated board box according to the second embodiment of the present invention, the same parts as the first embodiment of the present invention are designated by the same reference numerals and the explanation thereon will be avoided for the brevity of the description.

As shown in FIGS. 4A to 4C, the cut-off portions 30 are formed along the cutting line 20 on the both sides of the front surface plate 11 of the box body 10, and the cut-off protrusion 31 is formed by the inclined cutting line 21 on the edge of the one side of each of the cut-off portions 30, in the same manner as the first embodiment of the present invention. In the second embodiment of the present invention, however, the width of the supporting member 12 is designed to be larger than that of the supporting member 12 in the first embodiment of the present invention, and extended cutting lines 22 and 22' are formed by a predetermined width L" on the inner sides of the upper and lower portions of the cutting line 20. On the inner side between the extended cutting lines 22 and 22' and the supporting member 12 a folding groove 50 is vertically formed to be parallel therewith. The folding groove 50 and the cutting line 20 allow supporting protrusions 13 to be extended between inside vertical members 20'.

Therefore, if the cut-off portion 30 is detached using the cutting line 20, the supporting protrusions 13 are still attached on the both sides of the supporting member 12. At the time, if each of the supporting protrusions 13 is folded towards the inner side of the box body 10, centering the folding groove 50, the upper and lower ends of the supporting protrusion 13 are fitted into the upper and lower ends of the opening portion 40, which allows the opening portion 40 to be firmly supported.

Figure 5:
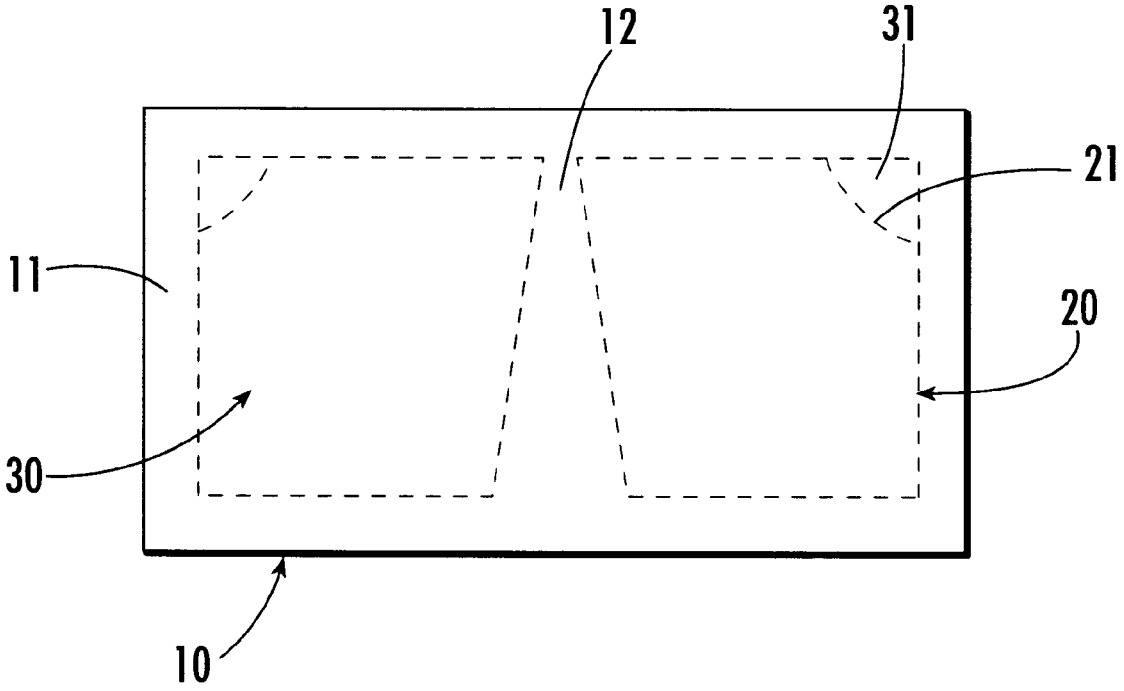
FIG. 5 is a front view illustrating a corrugated board box constructed according to a third embodiment of the present invention.

FIG. 5 is a front view illustrating a corrugated board box constructed according to a third embodiment of the present invention. In the explanation of the corrugated board box according to the third embodiment of the present invention, the same parts as the first and second embodiments of the present invention are designated by the same reference numerals and the explanation thereon will be avoided for the brevity of the description.

As shown in FIG. 5, the cut-off portions 30 are formed along the cutting line 20 on the both sides of the front surface plate 11 of the box body 10, in the same manner as the above. In the third embodiment of the present invention, however, the width of the upper portion of the supporting member 12 disposed on the center portion of the opening portion 40 of the box body 10 is substantially small, and contrarily, the width of the lower portion thereof is substantially large.

By the formation of such the supporting member 12, the loading applied to the upper end portion of the supporting member 12 is dispersed as reaches the lower end portion thereof, thereby helping the opening portion 40 to be firmly supported. In the first to third embodiments of the present invention, the cut-off portions 30 are formed on the front surface plate 11, but may be of course formed on all of the front and back surface plates. Also, the preferred embodiments of the present invention, the cut-off portions 30 of the box body 10 are formed in the rectangular shape, but may be formed in various shapes, for example, a diamond shape, a circular shape and so on.

Figure 6:
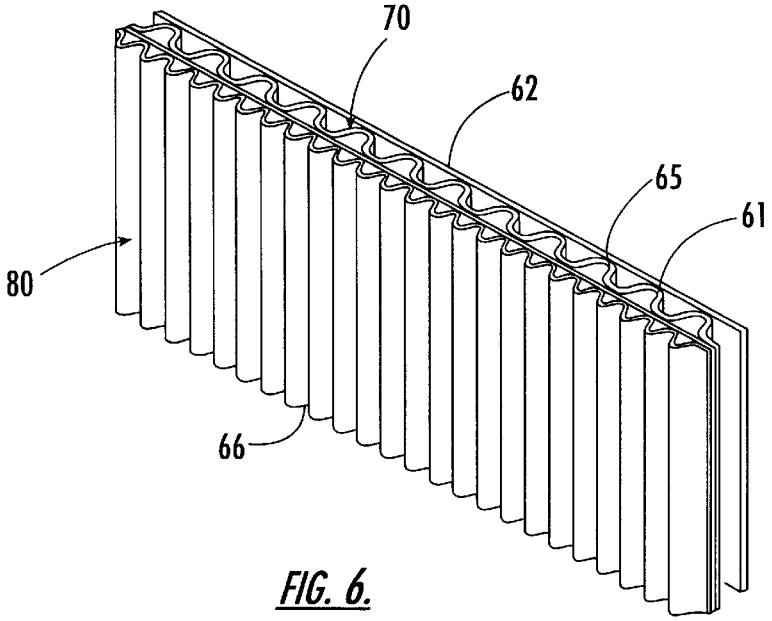
FIG. 6 is a perspective view illustrating one embodiment of a corrugated board applied in the present invention.
Figure 7:
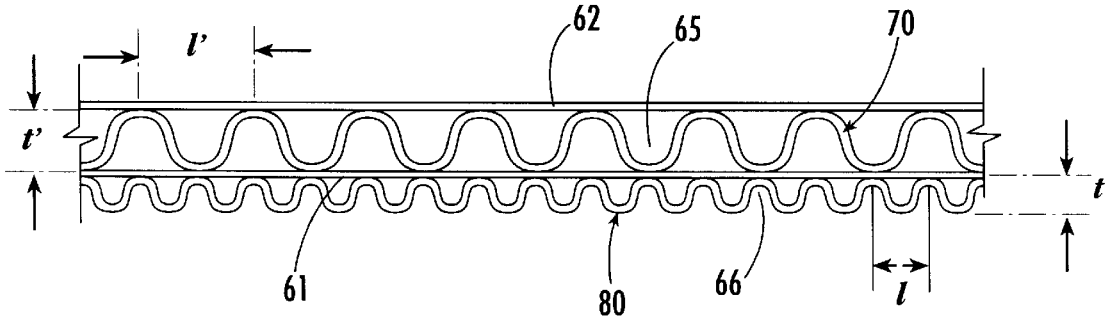
FIG. 7 is an enlarged plan sectional view illustrating the corrugated board of FIG. 6.

FIG. 6 is a perspective view illustrating one embodiment of a corrugated board applied in the present invention, and FIG. 7 is an enlarged plan sectional view illustrating the corrugated board of FIG. 6.

As shown in FIGS. 6 and 7, in the corrugated board applied in the present invention, a corrugated sheet 70 is formed between an inside plane sheet 61 and an outside plane sheet 62, and a reinforced corrugated sheet 80 is formed on the inside plane sheet 61.

The interval l and thickness t of the corrugation 66 each formed in the reinforced corrugated sheet 80 are designed to be half of the interval l' and thickness t' of the corrugation 65 each formed in the corrugated sheet 70.

Next, an explanation of another corrugated board applied in the present invention will be given.

Figure 8:
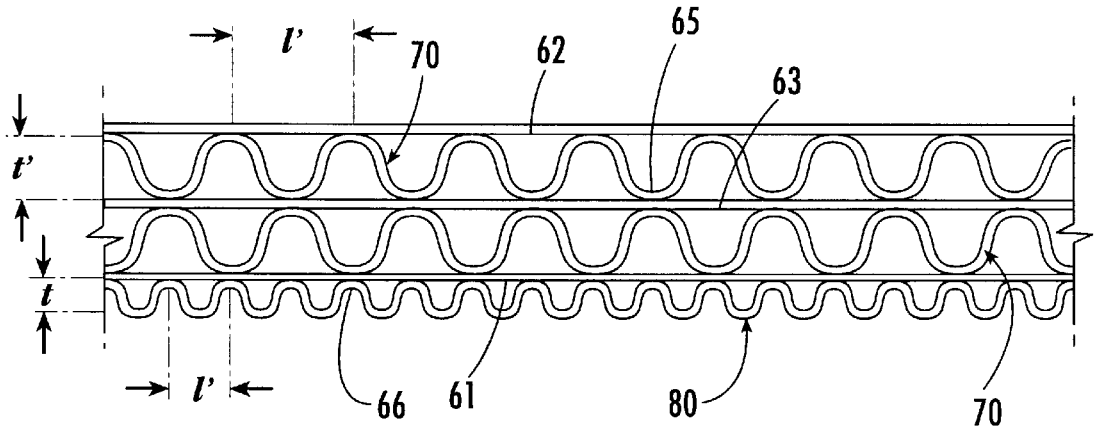
FIG. 8 is an enlarged plan sectional view illustrating another corrugated board applied in the present invention.

FIG. 8 is an enlarged plan sectional view illustrating another corrugated board applied in the present invention.

As shown in FIG. 8, in another corrugated board applied in the present invention, a third plane sheet 63 is formed between the inside plane sheet 61 and the outside plane sheet 62, corrugated sheets 70 are respectively inserted between the inside plane sheet 61 and the third plane sheet 63 and between the third plane sheet 63 and the outside plane sheet 62. The corrugated sheets 70 have the same interval and shape of corrugations. And the reinforced corrugated sheet 80 is formed on the outer surface of the inside plane sheet 61.

The interval l and thickness t of the corrugation 66 each formed in the reinforced corrugated sheet 80 are designed to be half of the interval l' and thickness t' of the corrugation 65 each formed in the corrugated sheet 70.

Figure 9:
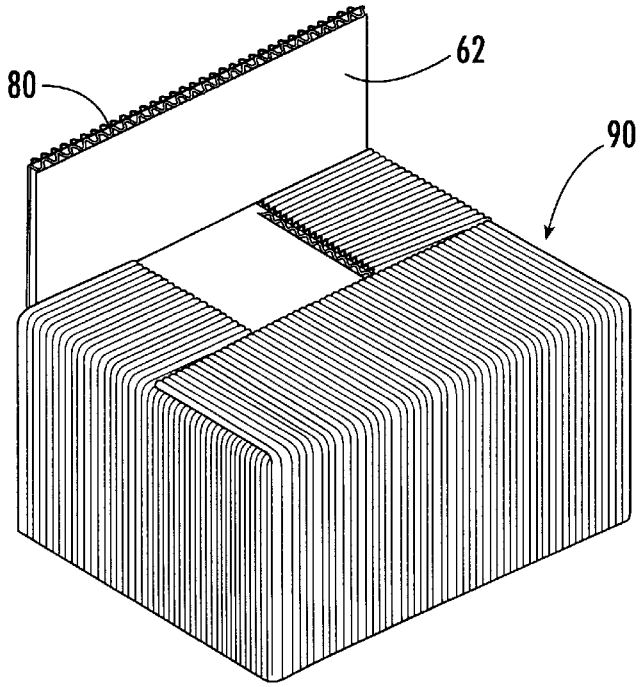
FIG. 9 is a perspective view illustrating use state of the corrugated board applied in the present invention.

Using the corrugated board as shown in FIGS. 6 to 8, a tetrahedral box is manufactured without having any clipper, and after the adhesive tape is attached on the outer side or inner side superposed on the tetrahedral box, a box body 90, as shown in FIG. 9, constructed according to a fourth embodiment of the present invention is manufactured.

In the fourth embodiment of the present invention, since the whole outer surface of the box body 90 is corrugated due to the reinforced corrugated sheet 80, the friction coefficient on the outer surface of the box body 90 is increased. Accordingly, when the box body 90 is lifted and delivered, or when a plurality of box bodies are stacked, occurrence of sliding among the boxes is not generated, to thereby easily deal with the boxes and to prevent the breakdown of the stacked boxes.

Furthermore, since the surface of the reinforced corrugated sheet 80 constituting the outer surface of the box body 90 is smooth and the outer surface of the box body 90 is corrugated, the printed character or picture on the outer surface of the box body 90 is in a three-dimensional state to render appearance of the box considerably sophisticated.

Specifically, because the outer surface of the box body 90 is corrugated, the contacted area with other objects is decreased, and because of the cushioning effect of the outer surface of the box body 90 itself, the impact received from the exterior is reduced and concurrently, the buffering effect is drastically improved. Thereby, the damage of the packaged commodities can be sufficiently prevented.

Figure 10:
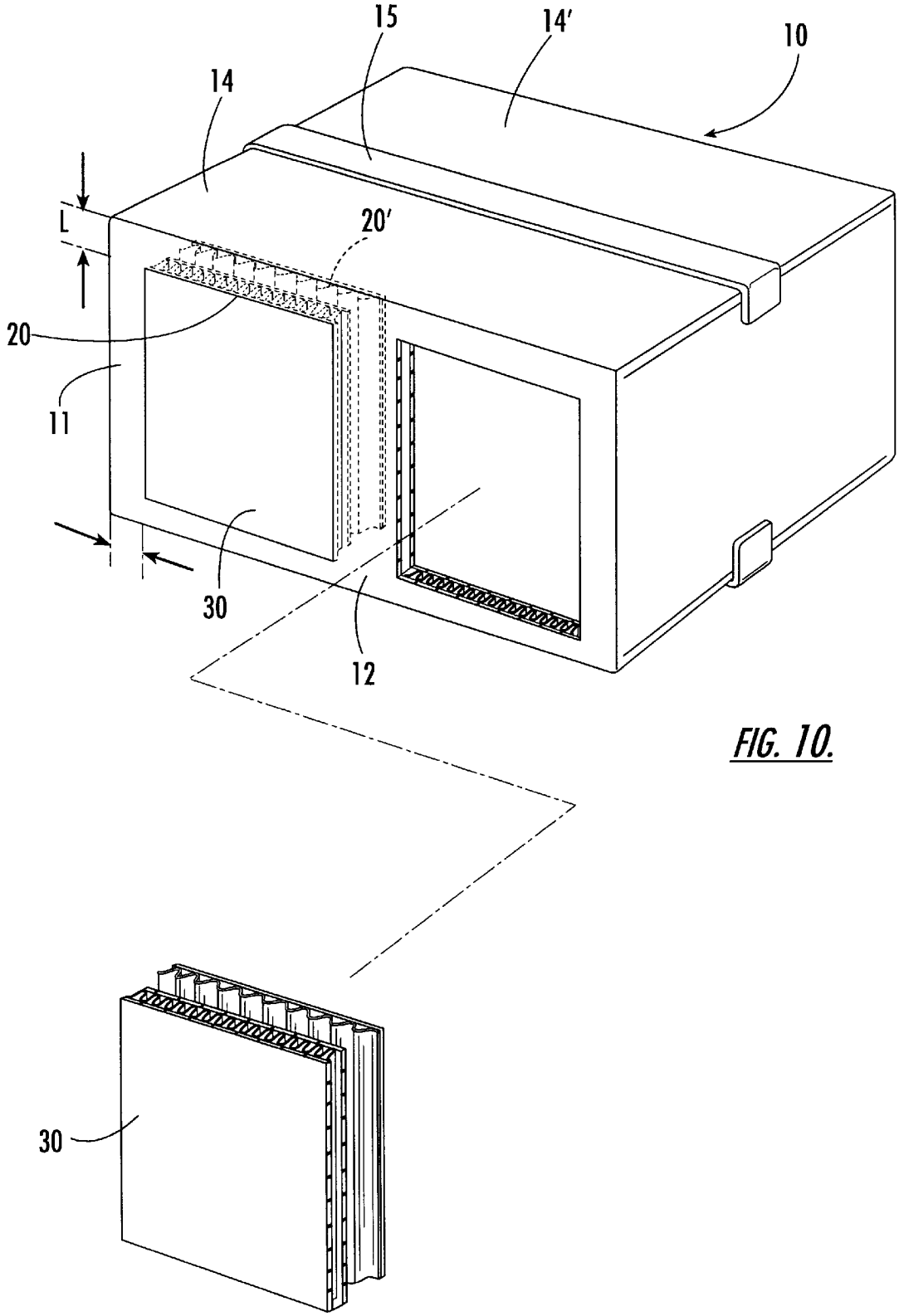
FIG. 10 is a front view illustrating a corrugated board box constructed according to a fourth embodiment of the present invention.

FIG. 10 is a front view illustrating a corrugated board box constructed according to a fourth embodiment of the present invention.

As compared with FIG. 1, the corrugated board box according to the fourth embodiment of the present invention removes the cut-off protrusion 31 which is formed by the inclined cutting line 21 on the edge of the one side of each of the cut-off portions 30, both ends of which are coupled with the cutting line 20. Instead of removing the cut-off protrusion 31, another cutting line 20' is formed to be crossed against the cutting line 20.

In other words, as shown in FIG. 10, the cutting line 20 is formed in a circular or square shape up to a predetermined depth from the surface of the box body 10, defined by the supporting member 12 on the center portion of the front surface plate 11 of the box body 10, and another cutting line 20' is formed to be crossed by about 1–10 mm against the cutting line 20 from the inner side of the box body 10.

Figure 11:
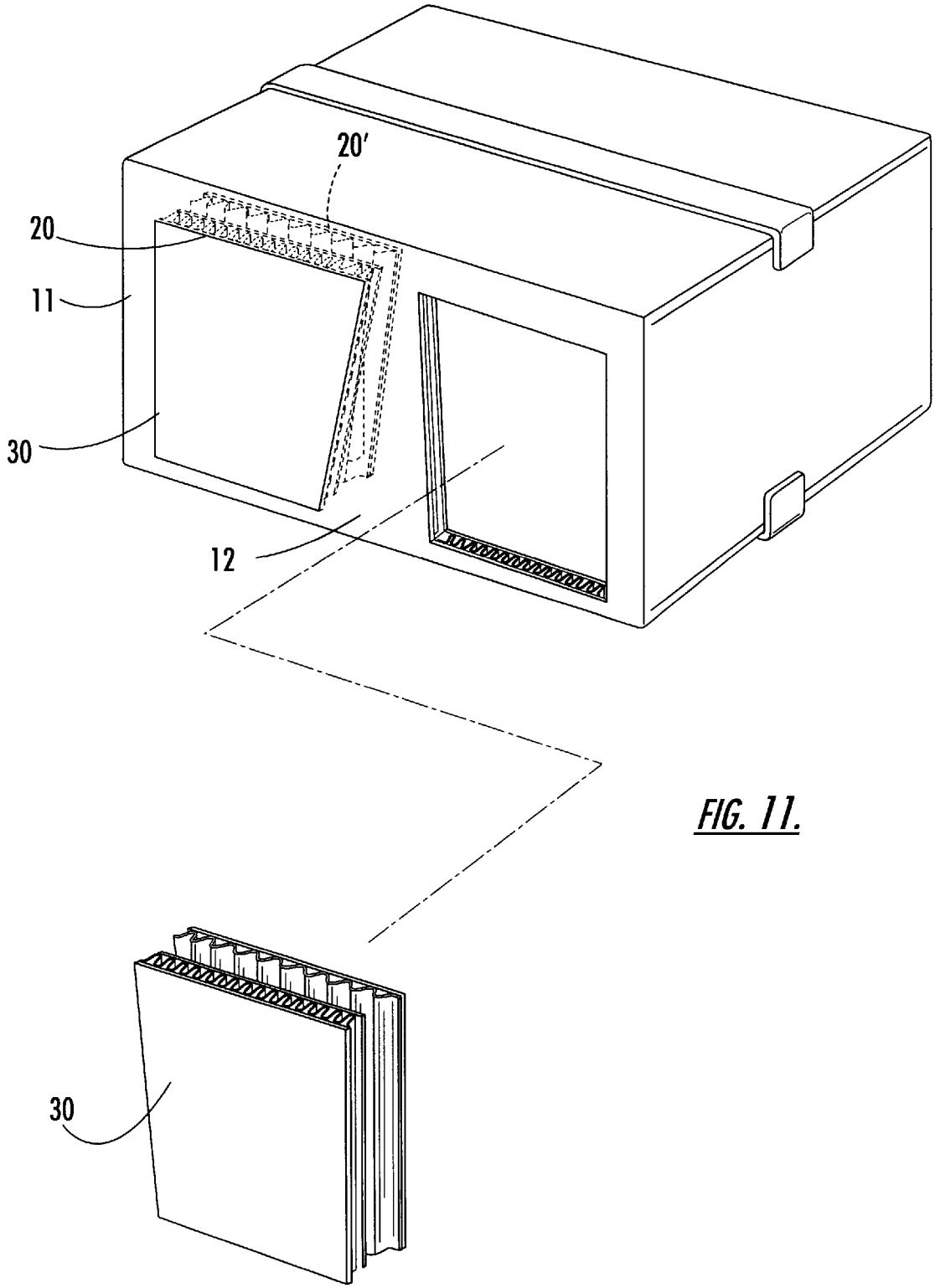
FIG. 11 is a front view illustrating a corrugated board box constructed according to a fifth embodiment of the present invention.

FIG. 11 is a front view illustrating a corrugated board box constructed according to a fifth embodiment of the present invention.

As compared with FIG. 5, the corrugated board box according to the fifth embodiment of the present invention removes the inclined cutting line 21, and instead of removing it, another cutting line 20' is formed to be crossed by about 1–10 mm in every direction against the cutting line 20.

In other words. as shown in FIG. 11, the cutting line 20 is formed in a circular or square shape up to a predetermined depth from the surface of the box body 10, defined by the supporting member 12 on the center portion of the front surface plate 11 of the box body 10, and another cutting line 20' is formed to be crossed by about 1–10 mm against the cutting line 20 from the inner side of the box body 10.

As shown in FIGS. 10 and 11, if the cutting line 20' is formed to be crossed by about 1–10 mm against the cutting line 20, the cut-off portion 30 partitioned by the cutting lines 20 and 20' can be easily cut off from the box body 10 when a punching force is applied from the exterior.

As set forth in the above, in the corrugated board box according to the present invention, without separating the adhesive tape from the cover plates and then taking the commodities contained in the interior of the box body, the cut-off portions on the front surface plate are only detached to freely display the types of commodities and the packaged shapes of commodities. Further, under the state where the plurality of box bodies are stacked, the commodities are exhibited without change or easily taken out of the interior of the boxes. Therefore, the commodities can be displayed in the packaged state within the box, without having an additional showcase and since an extra space such as a warehouse for storing the boxes can be greatly reduced, the cost of storage can be decreased. Additionally, since the box body is utilized as the showcase of the commodities, including the packaging and the storage, usage purposes of the box can be greatly diversified.

Furthermore, when the packaging box is manufactured with the corrugated board according to the fourth embodiment of the present invention, since the whole outer surface of the box body is corrugated due to the reinforced corrugated sheet, the friction coefficient on the outer surface of the box body is increased. Accordingly, when the box body is lifted and delivered, or when a plurality of box bodies are stacked, occurrence of sliding among the boxes is not generated, to thereby easily deal with the boxes and to prevent the breakdown of the stacked boxes. Moreover, since the outer surface of the box body is corrugated, the surface of the reinforced corrugated sheet is considerably smooth, when handled, and in the case where character or picture is printed on the outer surface of the box body, since the printed state of the outer surface of the box body is in a three-dimensional state, appearance of the box can be considerably sophisticated. Specifically, because the outer surface of the box body is corrugated, the contacted area with other objects is decreased, and because of the cushioning effect of the outer surface of the box body itself, the impact received from the exterior is reduced and concurrently, the buffering effect is drastically improved. Thereby, the damage of the packaged commodities can be sufficiently prevented.

On the other hand, when the box body is manufactured, only an adhesive tape, instead of paste can be used, since the flap is not formed on the center portion of the end of one side among the four sides of the packaging box. Further, since there is no flap when the commodities are taken in the interior of the box, the commodities are not locked by any the flap to unceasingly perform an automatic packaging process.

Moreover, in the packaging box according to the present invention, the reduction of the cost associated with warehouse for storing the boxes as well as the reduction of the cost for the arrangement of additional showcases can be all achieved. Further, in the packaging box having an outer surface thereof being comprised of a reinforced corrugated sheet, the following advantages can be given: a) the deliver or piling of the boxes can be easily executed; b) the appearance of the box can be greatly sophisticated; and c) the printed character or picture on the reinforced corrugated sheet is in a three-dimensional state.

What is claimed is:

1. A corrugated board packaging box capable of stacking, comprising:

two rectangular cut-off portions positioned abreast one another on a front surface plate of the box, said rectangular cut-off portions being formed by first perforated cutting lines, each of said first perforated cutting lines horizontally extending in parallel to a first margin having a width (L) from top and bottom edges of said front surface plate and second perforated cutting lines, each of said second perforated cutting lines vertically extending in parallel to a second margin having a width (L') from an associated side edge of the front surface plate;

a vertical supporting member formed between the two rectangular cut-off portions, said supporting member being adapted for supporting the top edge of the front surface plate relative to the bottom edge of an adjacent board packaging box, and;

two inclined cutting lines, each inclined cutting line positioned between one of said first perforated cutting lines which is positioned at said first margin from the top edge of the box and one of said second perforated cutting lines which is positioned at said second margin from the associated side edge, wherein said cut-off portions allow a plurality of commodities to be displayed in the box being adapted for allowing a user to easily take the commodities out of the box.

2. The corrugated board packaging box according to claim 1 wherein said front surface plate of said box comprises one of four sides of said box, the box is shaped into a desired configuration by integrating the top and bottom edges and said four sides of said box, and one of said associated edges of said front surface plate being without a flap and being adapted to be attached to one of said sides using an adhesive tape.

* * * * *